United States Patent [19]

Klein

[11] 3,942,343

[45] Mar. 9, 1976

[54] APPARATUS FOR DYEING AND PRINTING MATERIALS HAVING IMPROVED DYE RECIRCULATION MEANS

[75] Inventor: Norman E. Klein, Inman, S.C.

[73] Assignee: Deering Milliken Research Corporation, Spartanburg, S.C.

[22] Filed: May 17, 1974

[21] Appl. No.: 471,111

[52] U.S. Cl. ..... 68/205 R

[51] Int. Cl.[2] ..... D06B 1/02

[58] Field of Search ..... 68/205 R; 15/312 R; 134/166 C, 167 C, 168 C, 169 C; 239/112, 186

[56] References Cited

UNITED STATES PATENTS 2,218,811 10/1940 Chaussabel ..... 68/205 R 3,570,275 3/1971 Weber et al. ..... 68/183

*Primary Examiner*—Richard E. Aergerter
*Assistant Examiner*—L. Footland
*Attorney, Agent, or Firm*—Luke J. Wilburn, Jr.; H. William Petry

[57] ABSTRACT

Apparatus to apply dyes to a moving material to print the same which employs dye applicator gun bars to direct a plurality of streams of dye onto the moving material, and means for deflecting certain of the streams for dye in a predetermined sequence to impart a pattern to the material, and wherein adjustable collection means are provided for receiving the deflected streams of dye to facilitate the accurate printing of the material.

5 Claims, 10 Drawing Figures

APPARATUS FOR DYEING AND PRINTING MATERIALS HAVING IMPROVED DYE RECIRCULATION MEANS

This invention relates to the application of dyestuffs to textile materials and, more particularly, to the printing of textile fabrics having relatively porous surfaces, such as pile carpets.

Textile fibers and fabric materials have long been colored with natural and synthetic dyes, and, in particular, printed by color decoration of the surface or surfaces of the materials in definite repeated forms and colors to form a pattern. The color printing of textile fabrics has been accomplished in various ways. Earlier forms of printing used carved blocks charged with colored paste pressed against the fabric. Subsequently, speed of printing has been increased by the development of roller printing wherein moving fabrics are sequentially contacted by engraved metal rollers each containing a different color dye to form the desired pattern thereon. Textile fabrics are also printed by sequential contact with screens each having a porous portion of a pattern and carrying a particular color dyestuff.

More recently, it has been proposed to print textile fabrics, including pile carpets, by the programmed spraying or jetting of plural colored dyes onto the surface of a moving fabric. Typical of such processes and apparatus are described in U.S. Pat. No. 3,443,878; U.S. Pat. No. 3,570,275; and British Pat. No. 978,452. Generally, such apparatus consists of a plurality of dye applicator bars spaced along the direction of movement of the textile material and each containing multiple dye nozzles or jets extending transversely across the moving material. Each jet may be activated by suitable electric, pneumatic, or mechanical means to dispense dyes onto the moving material in a desired sequence, and pattern control of the jets may be accomplished by suitable programming means, such as coded punch tapes, magnetic tapes, computers, and the like.

U.S. Pat. Nos. 3,443,878 and 3,570,275 disclose specific means for applying streams of dyes to print a fabric by use of continuously flowing streams of dyes which are deflected by a stream of air to either impinge the dyestream upon the fabric or recirculate it to a reservoir. Control of such systems to form printed patterns may be accomplished by various of the aforementioned programming and control means.

In order to provide a greater variety of colors or shades of colors to the fabrics by use of such spray printing apparatus, it has also been proposed to apply different colors to the same locations or areas of the fabric to thereby blend primary colors in situ.

It can be appreciated that in the application of different colored dyes to the surface of textile fabrics, it is extremely important to accurately place each dyestuff on the fabric, particularly when intricate patterns are being printed and when in situ blending is employed. In dyeing relatively porous textile fabrics, such as pile carpets, it is also important that a carefully controlled amount of dye be applied to each dyed area on the pile surface to ensure optimum penetration of the dye color to the depth of the pile fiber without undesirable spread of the color into adjacent areas of the fabric. U.S. Pat. No. 3,393,411 discusses such a problem of dye penetration of pile carpet and suggests controlling the flow rate of the dyestuff and the speed of movement of the pile carpet past the dye application point to provide the desired amount of dye to the carpet.

In printing pile carpets with detailed patterns of colors, it can be appreciated that the dye jet applicators are very closely spaced relative to each other to permit dyeing in fine detail on the pile surface. The mounting, construction or programmed control of various gun bars for application of various dyestuffs to moving webs are also disclosed in British Pat. Nos. 1,201,598; 1,201,600; 1,201,599; and 1,202,345.

Also, in the pattern printing of wide yardage goods of continuous length such as pile carpets wherein width being printed may be as much as 15 feet, it can be appreciated that a high degree of accuracy is required in alignment of the gun bars and the jet dye streams issuing therefrom in order to ensure accurate and proper placement of the pattern across the entire width of the goods being printed. One such design and arrangement of the gun bar construction is disclosed in commonlyassigned co-pending U.S. Pat. Application Ser. No. 430,527, filed Jan. 3, 1974.

In gun bar constructions utilizing continuously flowing streams of dye which are intermittently deflected by a stream of air to produce the printed pattern on the material, such as disclosed in aforementioned U.S. Pat. Nos. 3,443,878 and 3,570,275, it is essential that the deflected dye streams do not inadvertently drip or spatter to contact the surface of the printed material. Therefore, it is necessary to provide collection means for the deflected dye streams which may be accurately positioned to compensate for variations in the path of deflection in the streams due to viscosity and/or pressure changes in the dye streams or the deflecting air streams.

The present invention, therefore, is concerned with improved apparatus for the jet printing of moving material including textile pile fabrics and the like having improved means for collecting deflected dye streams to ensure that they do not contact the material being printed.

The invention will be better understood by reference to the accompanying drawings which disclose a specific embodiment, and wherein.

Figure 1:
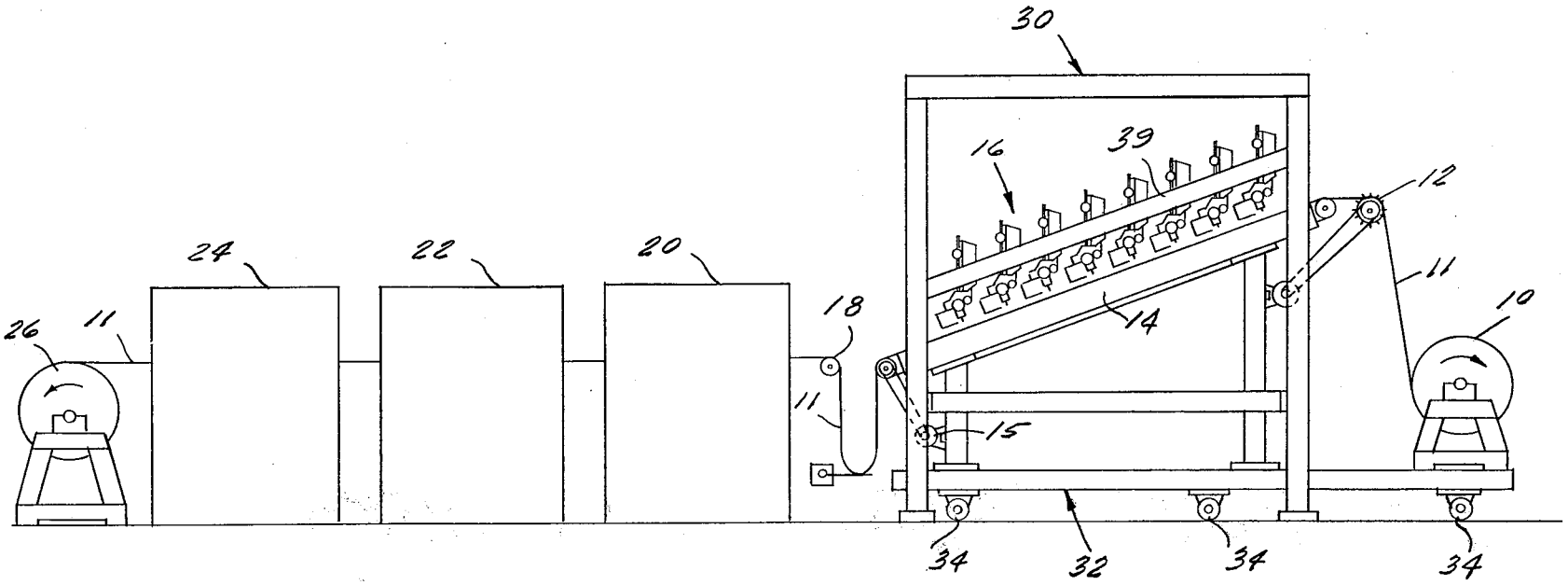
FIG. 1 is a schematic side elevation of an apparatus for the jet dyeing of textile materials.

Referring more specifically to the drawings, FIG. 1 shows a jet dyeing apparatus for color printing of moving materials, such as textile fabrics including pile carpets, tiles, and the like. As shown and described, the apparatus consists of a fabric supply source such as a tufted carpet roll 10 from which a continuous length of pile carpet 11 is drawn by a driven pin roller 12 and is delivered onto an inclined conveyor 14 which is driven by suitable motor means 15 to convey the carpet 11 beneath a dye applicator gun bar section 16, each gun bar of which dispenses plural streams of dye onto the carpet during its passage. The gun bars may be provided with different colored dyes and each of the plural streams of dye is programmed in suitable manner so as to apply the dyes to the surface of the carpet in a desired pattern.

The printed carpet leaving the conveyor 14 is directed by suitable conveying means, such as guide rolls 18, sequentially through a stream chamber 20, a water washer 22, and a dryer 24 where the printed carpet is treated in conventional manner to fix the dyes, remove excess dye, and dry the printed carpet, respectively. The carpet is then collected on a roll 26. Details of the dye fixing steam chamber, washer, and dryer do not form a part of the present invention and conventional apparatus for performing such conventional practices may be employed.

Figure 2:
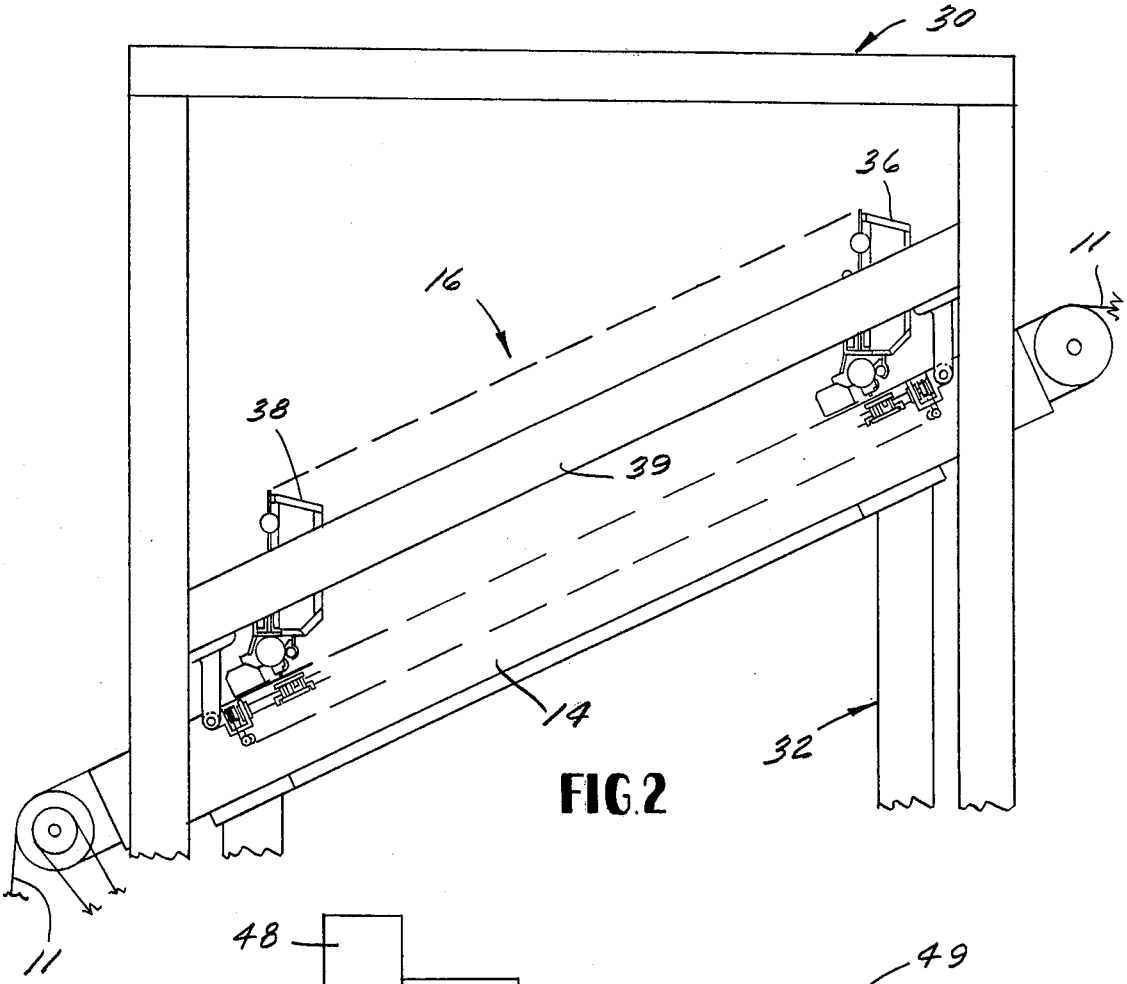
FIG. 2 is an enlarged schematic side elevation, with parts broken away, of the jet dye applicator gun bar section of the apparatus of FIG. 1, showing in more detail the arrangement and relation of the jet gun bars to the conveying means to transport the materials to be printed.

FIG. 2 is an enlarged side elevation, with portions broken away, of the gun bar section 16 and conveyor 14. As seen in both FIGS. 1 and 2, the gun bar section 16 and conveyor 14 are supported on a suitable frame 30 which includes a movable section 32 mounted on rollers 34 (FIG. 1) to permit removal of the conveyor 14 from beneath the gun bar section to facilitate cleaning, repair, and alignment of the gun bars.

As shown, gun bar section 16 includes a plurality of gun bars spaced along the conveyor 14 just above the path of travel of the carpet. Each gun bar is provided with a suitable color dye and is programmed to apply the dye from selected orifices therein to corresponding portions of the surface of the moving carpet. For convenience, only the first and last gun bars 36, 38 of the gun bar section 16 are shown in FIG. 2. The number of gun bars may be varied, as desired, depending on the particular color requirements of the pattern to be applied to the fabric. The gun bars are of substantially identical construction and extend across the conveyor and path of travel of the carpet thereon. Each gun bar is attached by suitable means, such as bolts, to diagonal beams 39 at each end of frame 30.

Figure 4:
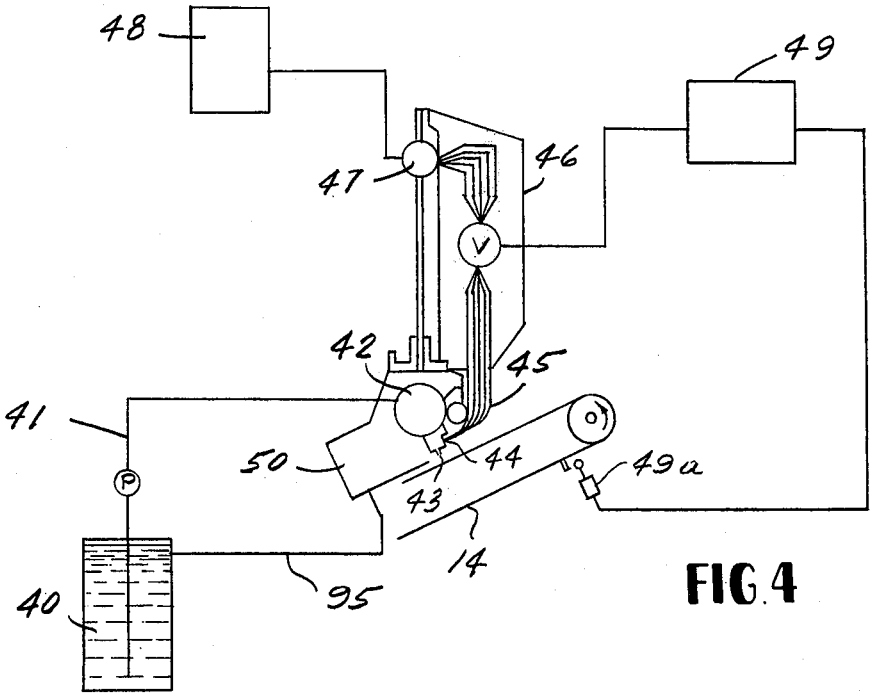
FIG. 4 is a schematic diagram of the system for supplying dye to and from, and air under pressure to, each of the gun bars, together with related control means for programming same.
Figure 6:
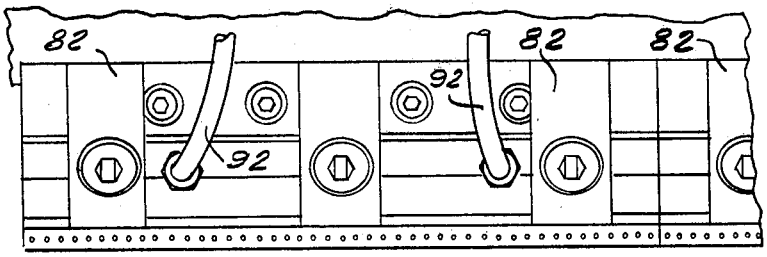
FIG. 6 is an enlarged view of a portion of the dye jet applicator section of the gun bar, looking in the direction of arrow 6 of FIG. 5, with portions broken away and removed to better show the mounting means for the dye jet applicator section and the associated air deflection means.
Figure 6A:
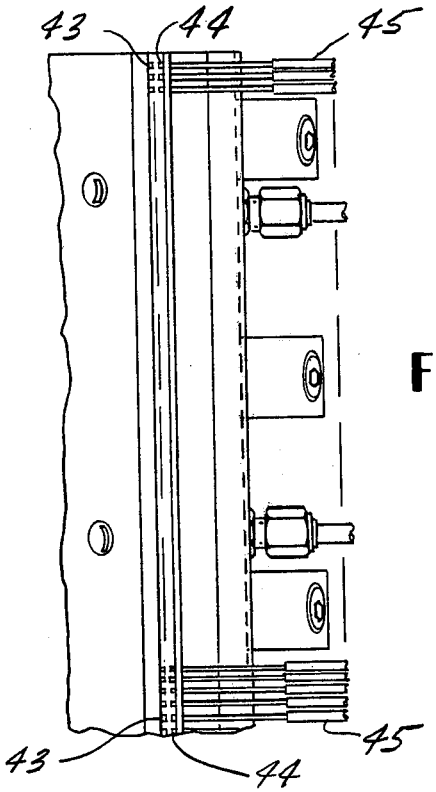
FIG. 6a is an enlarged view of a portion of the dye jet applicator section of the gun bar, looking in the direction of the arrow 6a of FIG. 5 and showing the dye jet orifices and their associated air supply conduits for deflecting the dye streams.

Each gun bar extends across the width of conveyor 14 transversely to the direction of movement of the carpet and contains a plurality of jet orifices closely positioned along the bar to direct dye in narrow streams toward the surface of the carpet as it passes thereby. As best seen in FIG. 4, each gun bar includes a separate dye reservoir tank 40 which supplies liquid dye by means of pump and conduit means 41 under pressure to a manifold or pipe 42 of the gun bar which communicates with the individual jet orifices 43 spaced along the length of the bar (FIGS. 6 and 6*a*). During operation, liquid dye is expelled continuously in small streams or jets from the orifices toward the material to be printed.

Positioned adjacent and at a right angle to the outlet of each jet orifice is an outlet 44 (FIG. 5) of an air supply tube 45, each of which communicates with a separate solenoid valve, illustrated collectively by the symbol V (FIG. 4). The solenoid valves, which are of the electric to fluidic interface type, such as LIF 180D3A12 made by The Lee Company of Westbrook, Connecticut are suitably supported on mounting cards in a card housing 46 and are supplied with pressurized air from a communicating manifold 47 and air compressor 48. Although a single valve symbol V is employed for convenience, it is to be understood that a solenoid valve and individual air supply tube is provided to serve each jet orifice of each gun bar such that individual streams of dye can be individually controlled.

The valves are controlled electrically by a pattern control device 49 to normally provide streams of air to impinge against the continuouslyflowing dyestreams and deflect the same into a catch basin or trough 50 from which the dye is recirculated to dye reservoir tank 40. The pattern control device 49 for operating the solenoid valves may comprise various conventional control means, such as a computer with magnetic tape transport for pattern information storage. information from control means 49 is fed to operate the solenoid valves off and on sequentially to print the carpet in a desired pattern as it passes beneath the set of gun bars.

In operation of the presently disclosed apparatus with the pattern control device supplying no information, dye under pressure is continuously supplied in a stream from each jet orifice 43 toward the textile material to be printed. Every solenoid valve is normally open to supply streams of air to impinge against the continuously flowing dye streams and deflect them all into the catch troughs of the gun bars for recirculation. As the first of the carpet to be printed passes beneath the first gun bar and the pattern control device is actuated, as by a trip switch 49*a* on the conveyor, certain of the normally open solenoid air valves are closed so that the corresponding dye streams are not deflected but impinge directly upon the textile material. Thus, by cutting on and off the solenoid air valves in a desired sequence, a printed pattern of dye is placed on the carpet during its passage.

Figure 3:
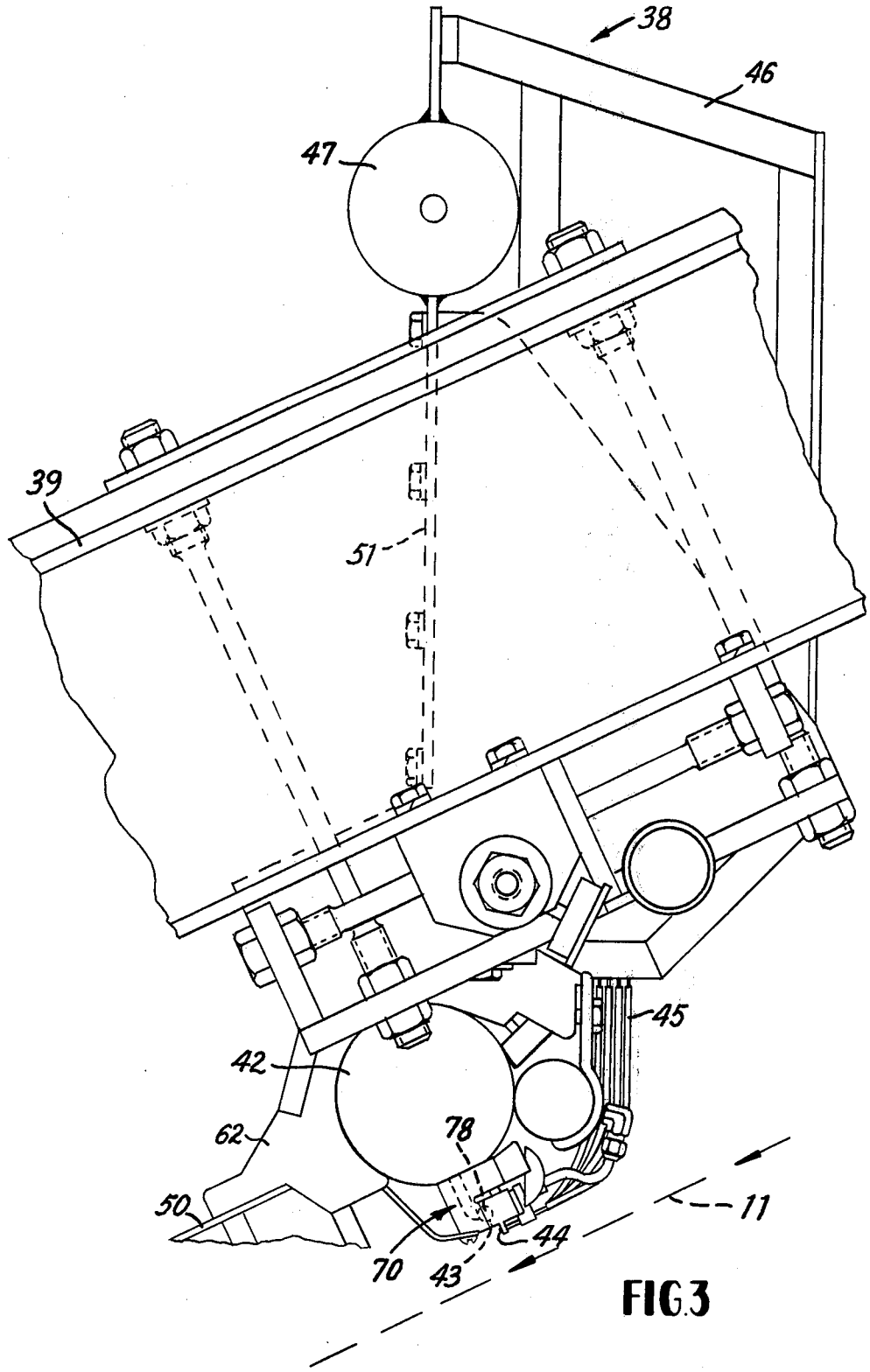
FIG. 3 is a further enlarged side elevation view, with parts broken away showing an individual dye applicator gun bar of the apparatus of FIGS. 1 and 2.
Figure 5:
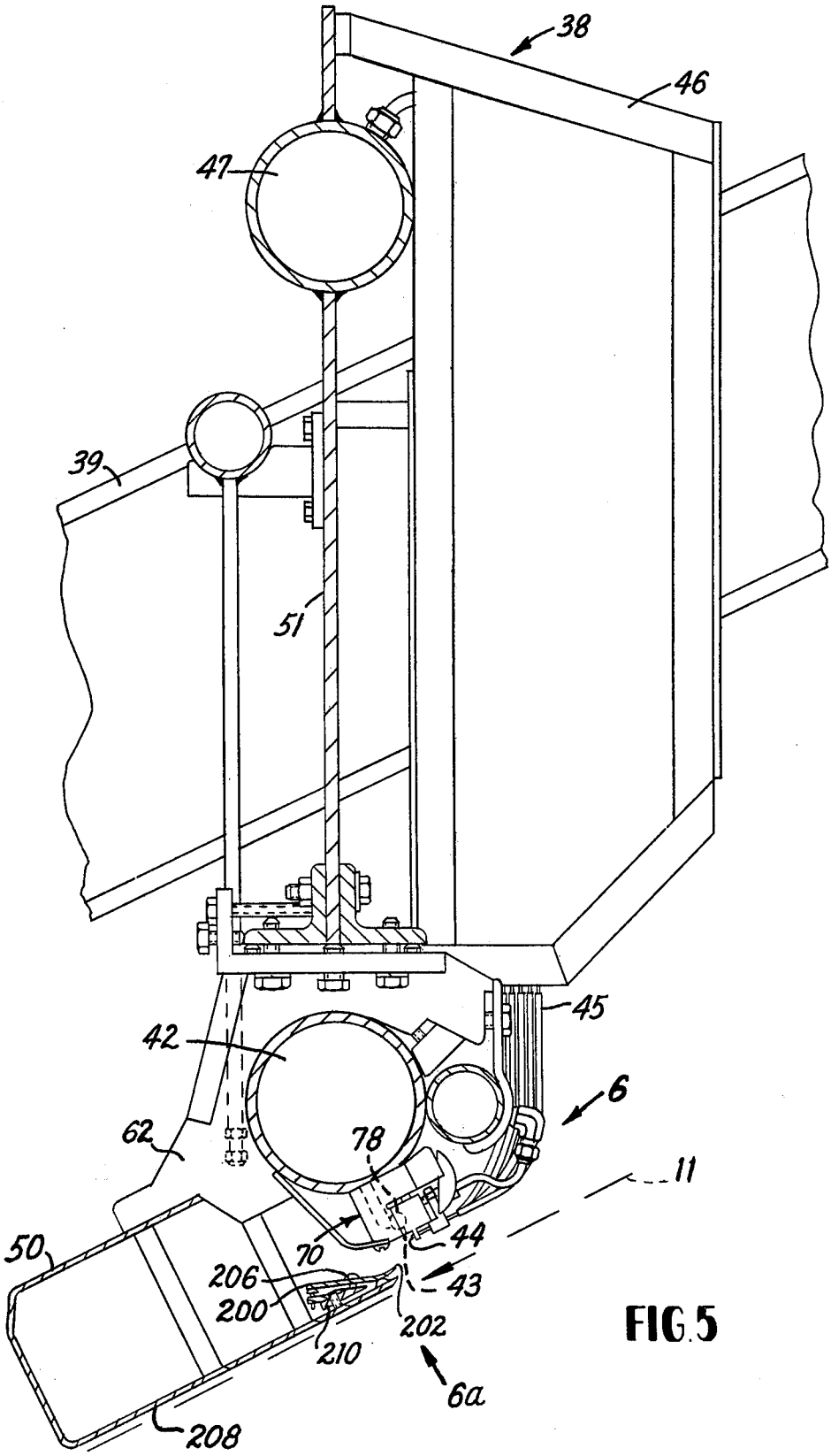
FIG. 5 is a side elevation view, with portions in section, of the gun bar of FIG. 3.

The details of the gun bar construction are best shown in FIGS. 3 and 5 which are an end view and a partial sectional view, respectively, of a portion of a gun bar 38. As seen, the gun bar is composed of a main, vertically disposed structural support plate 51 which extends the length of the gun bar across the path of material movement. Attached to the plate at its upper end is the air supply manifold pipe 47, and attached to the lower flanged end of the plate by a suitable bracket and clamp means 62 is the dye supply manifold pipe 42. Attached to and communicating with the dye supply manifold pipe is a jet applicator section 70 which has a dye receiving cavity or chamber 78 connected to the dye manifold 42 to pass dye to the plurality of dye jet orifices 43 (FIG. 6a) which emit streams of dye onto the material to be printed, as hereinbefore described. The details of the gun bar construction form the subject of co-pending, commonly assigned U.S. Pat. application Ser. No. 471,110, filed May 17, 1974.

As previously mentioned, the streams of dye emitted from the jet orifices 43 are normally deflected by the pressurized air streams into dye collection trough 50. When appropriate signals are sent by the pattern control means 49, the valves V controlling the pressurized air to the air outlets 44 are sequentially closed and opened to deflect or not deflect certain of the streams to place desired colored patterns on the moving carpet. Depending on the operating pressure and viscosity of the dye streams, as well as the operating pressure of the deflecting air streams, the deflected dyes may from time to time take slightly varying paths of deflection into the dye collection trough. To facilitate and ensure the collection of all of the dye liquid deflected, means are provided for adjustably positioning the receiving mouth or lip portion of the collection trough.

As best seen in FIGS. 5 and 7-9 the collection trough 50, which extends along the gun bar across the entire width of the conveyor 14, is provided with a movable lower lip plate 200 which is adjustable by movement generally along its length to position the edge 202 of the lip plate 200 inwardly and outwardly of the trough.

As seen the movable lip plate 200 is provided with follower pins or rivets 206 fixedly secured to the plate at spaced intervals along its length. The plate is operatively secured to the bottom wall 208 of the trough 50 by a plurality of cam-bracket means 210, each of which consists of a first section 212 having a pair of aligned slots 213, 214 (FIG. 8) which extend generally parallel to the edge 202 of the lip plate 200, and a second diagonally extending slot 215 which receives the follower pin 206 for sliding movement therein. First section 212 is operatively attached to the wall 208 by a pair of end-threaded bolts 216 which extend through the slots 213, 214 and are threadably secured in a second clamping section 218 on top of section 212.

Figure 7:
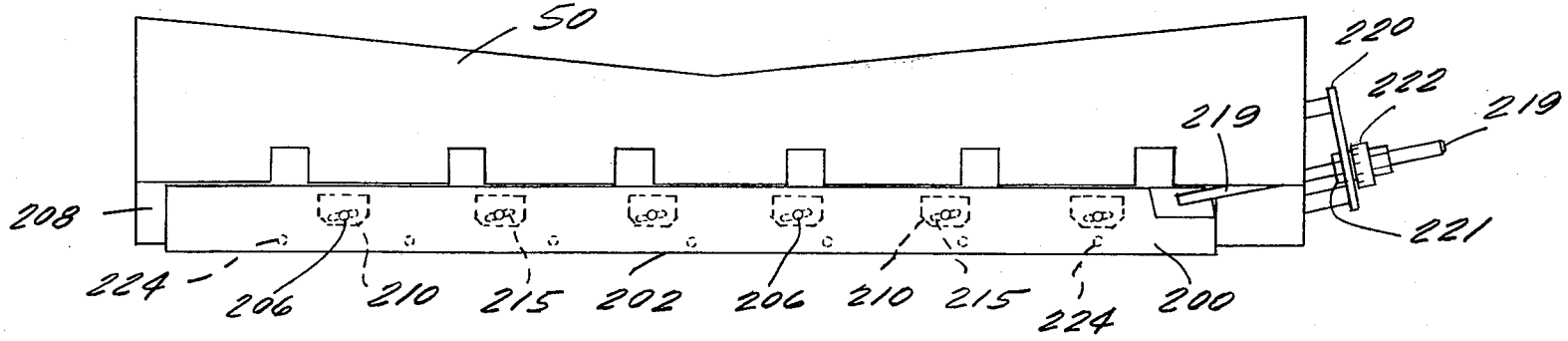
FIG. 7 is an enlarged generally overhead view of the dye collection trough of the gun bar seen in FIG. 5.
Figure 8:
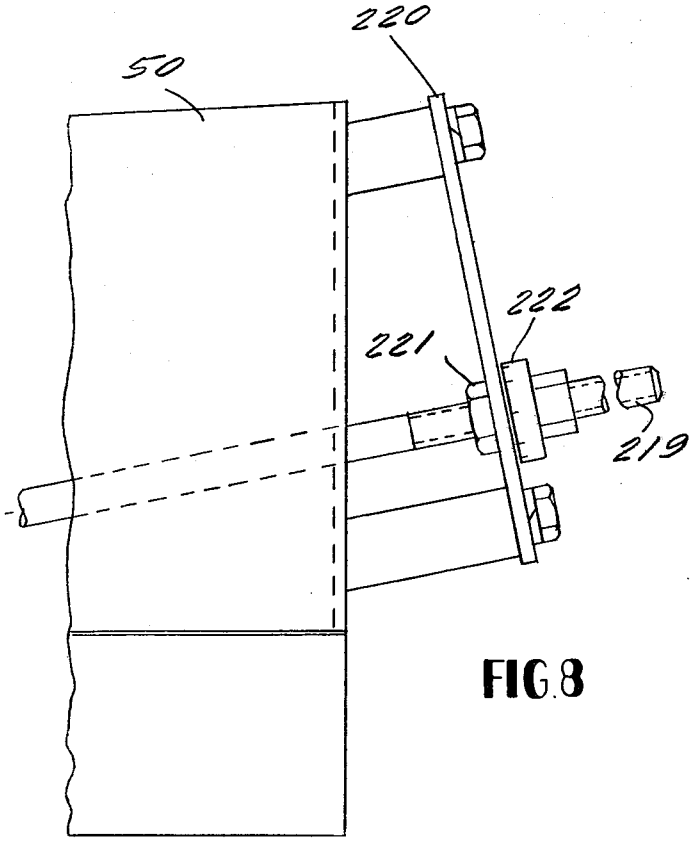
FIG. 8 is an enlarged partial plan view of the right hand portion of the dye collection trough of FIG. 7.
Figure 9:
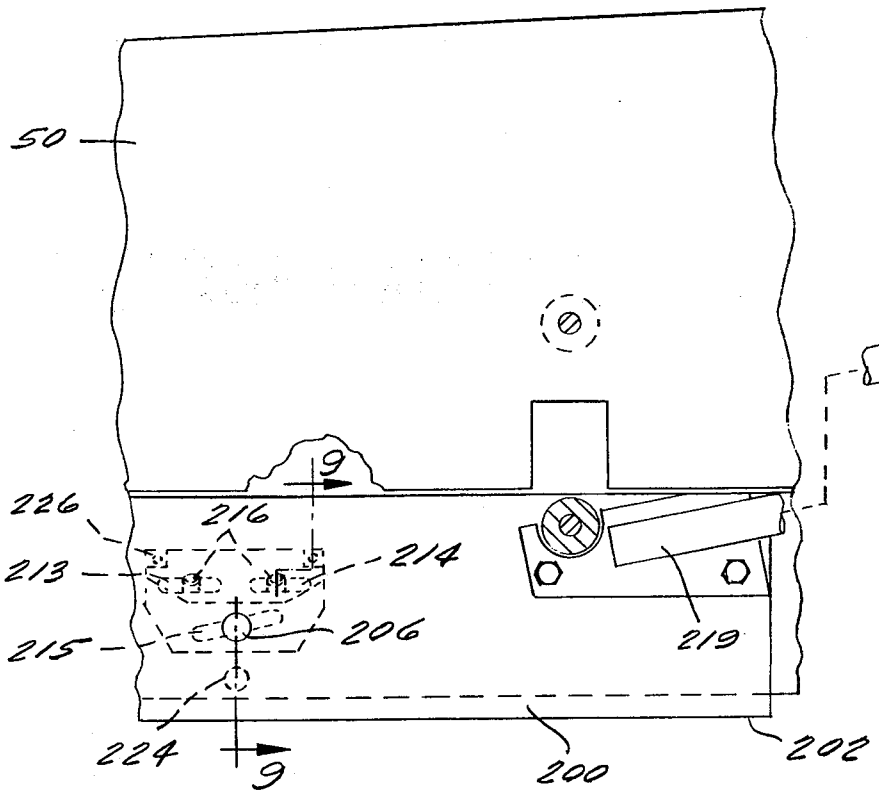
FIG. 9 is a sectional view of the lip plate of the gun bar collection trough, and its associated mounting means, taken along line 9—9 of FIG. 8.
Figure 9:
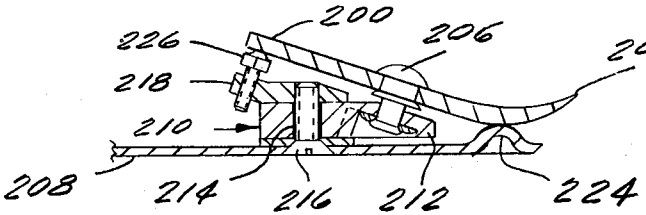

Supporting one end of lip plate 200 and extending at an angle therefrom is a threaded hex headed adjusting screw 219. The screw extends through a thrust plate 220 which is fixedly attached to the collection trough 50. Rod 219 is provided with a pair of nuts 221, 222, one of which, 222, bears a calibration scale, which positionally secures the rod to the thrust plate 220. As best seen in FIG. 7, the longitudinal axis of the adjusting rod 219 is parallel to the longitudinal axis of each of the diagonal slots 215 in the cam-brackets 210. By manually adjusting the nuts on the threaded rod the plate 200 can be moved generally longitudinally so that its follower pins slide along the diagonal slots of the cam-brackets. The slots serve as linear cam surfaces to move the edge 202 of the lip plate in or out on the trough 50 and position it closer to or further from the dye streams issuing from jet orifices 43. As seen in FIG. 8, the plate 200 is supported for such sliding movement on a detent 224 in the lower collection trough wall 208 and a spacer pin 226 on the cam-bracket 210.

With the construction described, it is possible to adjust the entire lower lip plate to move its edge toward or away from the streams of dye. In addition, by individually adjusting the position of each of the fastening brackets 210, as by sliding the brackets sideways along their slots 213, 214, adjacent portions of the edge 202 of the lip plate can be moved independently, in or out with respect to the trough 50. Thus, individual incremental adjustment along the edge of the lip plate and "gang" adjustment of the entire lip plate edge can be accomplished to provide accurate alignment of the edge. Therefore, depending on the viscosity and pressure of the dye streams and the pressure of the deflecting air, the lip plate can be adjusted manually to catch the deflected dye for return to the dye reservoir tank. This ensures optimum collection of all of the deflected dye streams along the gun bar.

That which is claimed is:

1. In apparatus for applying dye to a moving material including means for moving a material to be dyed in a path of treatment, at least one elongate dye jet gun bar positioned adjacent the path and having a row of dye-emitting orifices spaced along the bar for directing dye in plural streams onto the material, means positioned to one side of said row of orifices for selectively deflecting one or more of the dye streams emitted by the orifices away from the path of material treatment, and a dye collection trough positioned along the other side of said row of orifices and having an elongate opening extending along the row of orifices adjacent thereto for receiving the deflected dye from said plural streams therein; the improvement wherein said dye collection trough includes an elongate movable plate having an elongate edge defining the elongate boundary of said opening which is remote from said dye-emitting orifices, and camming means mounting said plate to said trough for sliding movement along said collection trough to variably position the edge of the plate relative to the dye orifices and dye streams directed therefrom, whereby collection of dye deflected from said streams is facilitated.

2. Apparatus as defined in claim 1 wherein said collection trough includes a fixed wall, said means mounting said plate for sliding movement comprises cam means positioned on said dye collection trough wall and engaging said elongate movable plate at points along its length for directing the plate edge inwardly and outwardly of said trough in response to sliding movement of the plate generally along the length of the dye collection trough.

3. Apparatus as defined in claim 2 wherein said cam means comprise a plurality of fastening means spaced along said trough wall, each of said fastening means having a first elongate slot, and a plurality of pin means positioned at corresponding points along said plate engaging said slots for sliding movement therein, said slots extending generally parallel to each other and at an angle to the longitudinal axis of said plate and the edge thereof whereby displacement of the plate in the direction of its longitudinal axis causes movement of said edge inwardly or outwardly of said trough.

4. Apparatus as defined in claim 3 wherein each of said fastening means includes means for independently adjustably positioning said elongate slot therein along the length of said trough to produce an inward or outward displacement of the adjacent edge portion of said plate due to the camming action of said pin means in said slots.

5. Apparatus as defined in claim 4 wherein said means for adjustably positioning each of said fastening means comprises a plurality of slots extending generally along the longitudinal axis of said plate and trough, and pin means positioned for slidable movement in said slots.

* * * * *